United States Patent [19]

Burgess

[11] 4,255,692

[45] Mar. 10, 1981

[54] NON-LIGHT PRODUCING PHOSPHOR ENERGIZABLE LAMP SIMULATOR AND METHODS OF USING SAME AND MAKING SAME

[76] Inventor: David Burgess, 1341 W. 130th St., Gardena, Calif. 90247

[21] Appl. No.: 73,223

[22] Filed: Sep. 7, 1979

[51] Int. Cl.[3] ..... H05B 41/16

[52] U.S. Cl. ..... 315/324; 315/187; 315/189; 315/228; 315/312

[58] Field of Search ..... 315/122, 126, 189, 312, 315/324, 228, 231, 187; 313/212, 220, 485, 493

[56] References Cited

U.S. PATENT DOCUMENTS

| | | | |
|---|---|---|---|
| 2,392,661 | 1/1946 | Greiner | 313/220 X |
| 2,814,748 | 11/1957 | Cox | 313/212 X |
| 3,956,665 | 5/1976 | Westphal | 315/312 X |
| 4,053,811 | 10/1977 | Abernethy | 315/324 X |
| 4,107,581 | 8/1978 | Abernethy | 315/324 |

*Primary Examiner*—Eugene R. LaRoche
*Attorney, Agent, or Firm*—Romney, Schaap, Golant, Disner & Ashen

[57] ABSTRACT

A lamp simulator for use as a replacement for a phosphor excitable lamp, such as a fluorescent lamp in a plural lamp fixture. The fixture is typically one with socket-type connectors adapted to have at least two or more phosphor excitable lamps mounted therein. The lamp simulator replaces one or more of the illuminatable lamps in the fixture. The simulator comprises a lamp body or housing having end caps on each of the transverse ends and generally has a size approximately equal to a lamp it replaces. In one embodiment, a capacitor may be physically mounted on one of the end caps and is electrically connected to one of the terminals on the end cap and electrically connected to a terminal on the other of the end caps. Further, the caps may have a diametral size at least slightly greater than the lamp tube such that a plurality of lamps can be packed in a single container without a separate jacket for each lamp. In another embodiment, the lamp is provided with an irregular surface as for example, a plurality of longitudinally extending spaced apart ridges on the interior surface of the lamp housing in order to create light dispersion and substantial elimination of shadows. Thus, the light simulator effectively takes the place of an actual lamp in that it appears as though light is actually coming from the said lamp simulator and thereby simulates an actual lamp. The invention also provides a method of securing an electrode of the capacitor to a terminal on the lamp end cap as well as a method of non-visably perceptably removing phosphor energizable light producing lamps and replacing such lamps with non-light producing lamp simulators.

27 Claims, 13 Drawing Figures

NON-LIGHT PRODUCING PHOSPHOR ENERGIZABLE LAMP SIMULATOR AND METHODS OF USING SAME AND MAKING SAME

BACKGROUND OF THE INVENTION

1. Field of the Invention

This invention relates in general to certain new and useful improvements in substitute lamp simulators as replacements for phosphor excitable lamps in plural lamp fixtures, and more particularly, to lamp simulators of the type stated which effectively simulate an operable energizable lamp and which are relatively low cost, as well as methods of using the same and manufacturing the same.

2. Brief Description of the Prior Art

In recent years, there has been an interest in reducing the number of fluorescent lights in multi-fluorescent lamp fixtures in order to reduce energy requirements. The same holds true with the phosphor energizable lamp fixtures such as the fixtures which operate with the so-called cathode discharge lamps. For example, in many office buildings and other forms of commercial installations, it has been found that one or more of the lamps in a multi-lamp fixture can be removed without appreciably reducing the total light output so that inefficiency and eye fatigue does not result. In other words, many commercially available fixtures were constructed so that an excess of light was generated for a given purpose.

Conventional fluorescent lamp fixtures were often constructed to hold and energize two lamps. The ballast and circuitry were designed so that each of said lamps were 180 degrees out of phase. In this way, flicker was canceled out to some extent. Thus, two lights were employed or otherwise lights in pairs were employed to reduce noticeable effects of flicker even though the extra lumen output was not required.

One of the problems involved in removing a lamp, as for example, a fluorescent lamp, from a two lamp fixture was the fact that the ballast was not effective to operate only one of the lamps. Thus, in a two-lamp fixture where a ballast was provided, and one of the lamps was burned out, the other of the lamps would not operate or otherwise operated inefficiently with an excess of power.

In order to obviate these problems, there has been a proposed capacitive operable device which was connected between the terminals of a fluorescent lamp which has been removed in a two fluorescent lamp fixture. In this way, the remaining lamp could operate without a substantial loss of lumen output and also minimizing the power factor deterioration. This system is more fully described in U.S. Pat. No. 3,956,665 to Westphal, et al. Another prior art system for permitting removal of one of the fluorescent lamps in a multi-lamp fixture and using a device connected to the sockets where the lamp has been removed is more fully described in U.S. Pat. No. 4,053,881 to Abernathy. In this case, a non-reactive lamp circuit was employed.

In each case, while a means was employed to enable the remaining lamp and fixture to operate, the means employed was not effective in reducing the obvious noticeable effect of a missing lamp. In the case of the Westphal et al. system, the use of a mere capacitor in circuit was employed. While the Abernathy device did employ a lamp, it still appeared as though the lamp housing or bulb was burned out. Moreover, and in each case, it required substantial amount of effort in order to remove the existing construction and install a new construction. While the Abernathy device did employ a bulb with end caps and a terminal, it also suffered from the very substantial disadvantage that it could not be easily repaired.

The state of the art is such that the prior art devices are quite rudimentary. While they are designed to find a solution to a problem, they were not designed to represent the bulbs they replace or simulate. To this extent these prior art devices, while not physically appearing as the lamp they replace are referred to as "simulators" in this present application. For example, these prior art devices were not designed in a manner where end caps could be easily removed for replacement of the wire or the capacitor if the need should arise, and they were not made of a non-breakable material.

In the various prior art simulators as for example, the type illustrated in the Westphal et al patent and the type illustrated in the Abernathy patent, the wire extending across the bulb coud actually be seen. Any vibration in the room would cause the wire to vibrate and which was highly noticeable to an observer. Moreover, an observer looking at the lamp simulator will almost inevitably notice a vibration of the wire extending across the lamp simulator in these prior art devices and this is rather distracting.

The prior art lamp simulators were all constructed of glass, primarily due to the fact that the glass was made to a pre-cut size for use in the existing fluorescent bulb. Moreover, the prior art devices were apparently constructed of glass, due to the fact that plastic materials would tend to sag when constructed in lengths of six foot or greater. Another significant problem with the prior art lamp simulators is the fact that the construction was quite similar to that of an existing fluorescent bulb, even though it did not have the appearance of an existing fluorescent bulb. As a consequence, the end caps had a dimetral size which was slightly less than the actual size of the bulb itself. At least for purposes of shipment, each individual lamp simulator had to be thereafter shipped in a larger container. This of course materially added to the cost of production and distribution and hence, the overall cost of the simulator.

Further, and more importantly, these prior art simulators appeared as a dead bulb which is quite distracting to the observer. Typically, the user of an environment, which is lighted by these fluorescent lights or other phosphor energizable lamp, can perform quite satisfactorily without any perceptable loss of light, so long as the user believes that the same light output is present. However, when the user observes that a number of the lightbulbs in a particular environment have been removed and replaced, or otherwise appear to be dead, the user physiologically perceives of a loss of light. The present invention overcomes these as well as other problems.

OBJECTS OF THE INVENTION

It is, therefore, a primary object of the present invention to provide a substitute lamp simulator as a replacement for a phosphor energizable lamp in a plural lamp fixture and which simulator is designed so that it appears as an operating lamp when disposed into an adjacent relationship to another operating lamp.

It is another object of the present invention to provide a lamp simulator of the type stated in which light from an adjacent operating lamp can be dispersed through the housing of the simulator to thereby create an appearance that the lamp simulator is generating light.

It is a further object of the present invention to provide a lamp simulator of the type stated which adopts the same overall size and shape as a lamp which has been removed from the fixture and which is provided with terminal means for mounting within the socket-type connector of the fixture from which an energizable lamp has been removed.

It is an additional object of the present invention to provide a substitute lamp simulator of the type stated in which a capacitor can be physically mounted on one of the end caps and electrically connected to the terminal means on the other of the end caps by an electrical conductor which facilitates easy replacement and repair.

It is also an object of the present invention to provide a lamp simulator of the type stated in which end caps are constructed with an overall diametral size larger than the bulb housing such that a plurality of bulbs can be packaged in an individual container without each lamp being pre-packaged.

It is another salient object of the present invention to provide a method of securing a conductor to a terminal on an end cap of a lamp simulator in which solder is caused to flow into the terminal during the sealing of the conductor to thereby provide a highly effective and efficient wire sealing means.

It is still another object of the present invention to provide a method for relatively non-visably perceptably removing a phosphor energizable light producing lamp in an array of such lamps and replacing at least some of these light producing lamps with non-light producing lamp simulators.

With the above and other objects in view, my invention resides in the novel features of form, construction, arrangement, and combination of parts presently described and pointed out in the claims.

BRIEF SUMMARY OF THE DISCLOSURE

The present invention provides a substitute non-illuminatable lamp or so-called substitute lamp simulator as a replacement for a phosphor energizable lamp in a plural lamp fixture. In this case, the phosphor energizable lamp may be any type of lamp which is energized by excitable phosphors, as for example, the conventional fluorescent lamp, and the so-called "cathode discharge" lamp. Conventionally, such lamps usually are mounted in the socket type connectors of a plural lamp fixture.

In one embodiment of the lamp simulator of the present invention, the simulator comprises a tubular lamp housing with end caps on opposite ends of the housing. A terminal means is typically located on each of the end caps and capable of being fitted into the connectors which receive the terminals of an actual phosphor energizable lamp. The terminal means may vary depending upon the particular type of lamp and socket type connectors employed.

In this one embodiment of the invention, a capacitor is physically mounted on one of the end caps and is electrically connected to the terminal means on that end cap. Further, the capacitor is connected to an electrical conductor means which is electrically connected to the terminal means on the other end.

In this way, easy mounting of the capacitor is provided, and easy replacement and repair of the lamp simulator is afforded.

Typically, the lamp simulator may adopt the form of a fluorescent lamp tube and is therefore somewhat tubular and elongate in shape. The electrical conductor means is preferably a wire extending within the housing and the housing itself is preferably formed of a relatively non-breakable plastic material. In one aspect of the invention, it is possible to eliminate the capacitor itself and use a high resistivity wire in order to thereby provide a non-reactive system.

In another embodiment of the present invention, the lamp housing is provided with a plurality of closely spaced apart elements on the interior surface of the lamp and which are located for at least the greater portion of the length of the lamp. In this way, the lamp is provided with an irregular interior surface effect. This interior surface effect is highly desirable in creating substantial light dispersion and substantial elimination of shadows. In this way, an energizable lamp in proximity to the lamp simulator causes light to disperse through the housing of the lamp simulator and thereby create an appearance that the lamp simulator is actually generated light. Thus, it appears to the viewer that both the lamp simulator and the lamp adjacent thereto are operating to produce the full light output as if all lamps were energized and operating.

In a preferred aspect of the invention, the spaced apart elements are preferably spaced apart generally elongate extending ridges. Further, these ridges preferably extend for the greater portion, if not the entire length of the lamp housing. In this way, it is possible to get a better light dispersion than with other forms of irregular surface effects.

The present invention also provides a method for relatively non-visably perceptably removing phosphor energizable light producing lamps in a generally rectangular array of such lamps and replacing these lamps with non-light producing lamp simulators; that is the substitution of the simulators for light emitting lamps is not visably perceptable to the user of the environment in which the simulators have been replaced for light emitting lamps. Thus, in a generally rectangular array of these lamps, there are a plurality of rows of lamps with each row having a plurality of rows of lamps with each row having a plurality of lamps of the type normally found in many industrial establishments. In accordance with the method, alternate light producing lamps in each row of the rows of light producing lamps are removed. The method comprises the replacing of the removed light producing lamps in the rows with non-light producing lamp simulators having an appearance somewhat similar to the removed light producing lamps. In this way, a lamp simulator in one row will be located adjacent to a light producing lamp in the next adjacent row. After a period of time, the method comprises removing all of the light producing lamps in each of the alternate rows and replacing the removed lamps with additional non-light producing lamp simulators.

The invention also provides a method of fabricating the lamp simulators as a replacement for phosphor energizable lamps in a plural lamp fixture. In this case, and as indicated previously, the lamp simulators include a housing with end caps on the housing. Each of these end caps is preferably produced with one or more terminals and an aperture extending through the terminal or terminals. In accordance with the method, an end of an electrically conductive wire is inserted into and through the aperture in the terminal. Thereafter, the terminal is heated to cause an expansion of air in the terminal and a partial removal of the air in this terminal. Simultaneously therewith, a solder material is applied to the terminal during the hating so that solder is caused to actually seep into the aperture during the partial removal of air. In this way, the solder which is caused to seep into the terminal bonds the end of the electrically conductive wire within the terminal, creating a highly effective wire-type seal.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
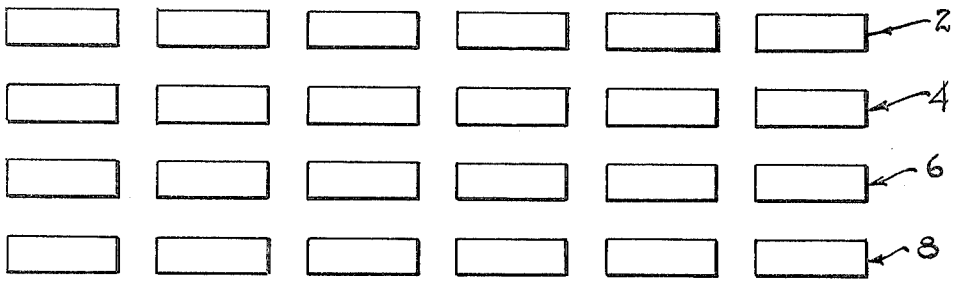
Figure 2:
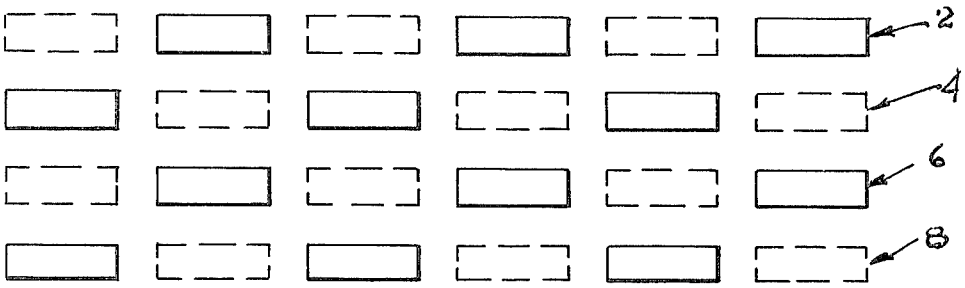
Figure 3:
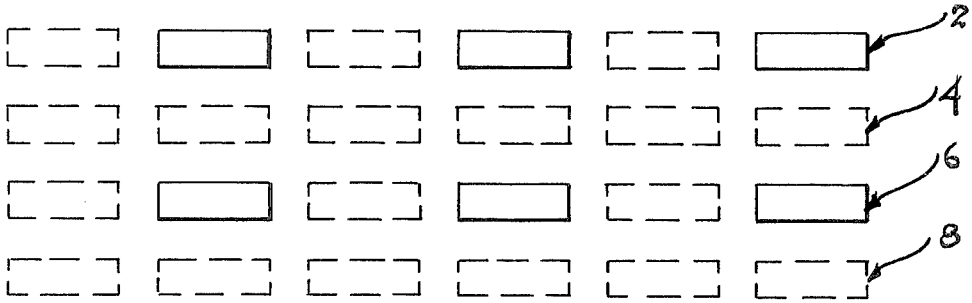
Figure 4:
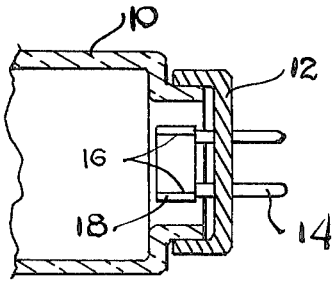
FIG. 4 PRIOR ART
Figure 5:
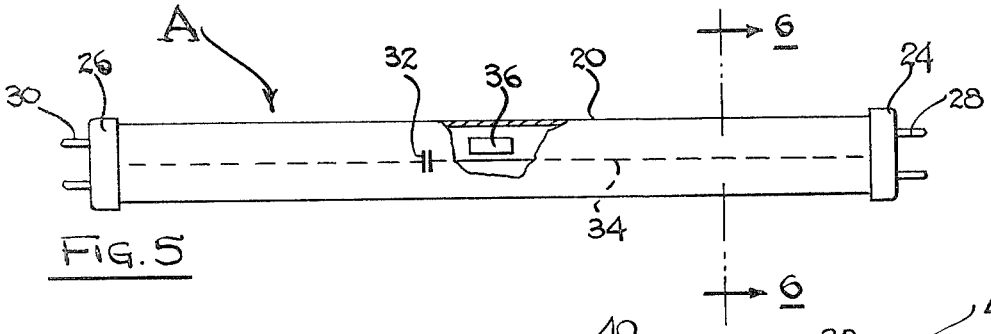
Figure 6:
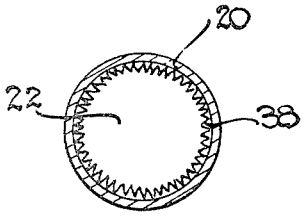
Figure 7:
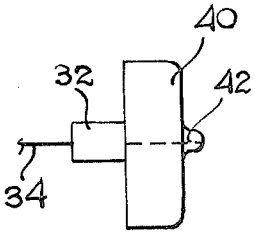
Figure 8:
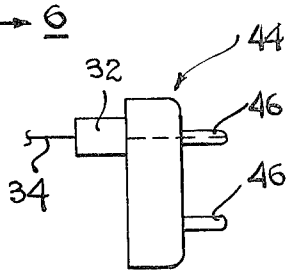
Figure 9:
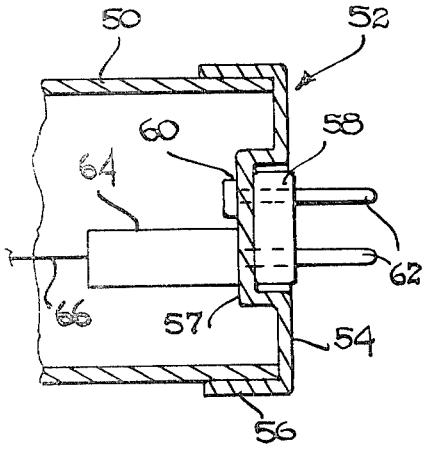
Figure 10:
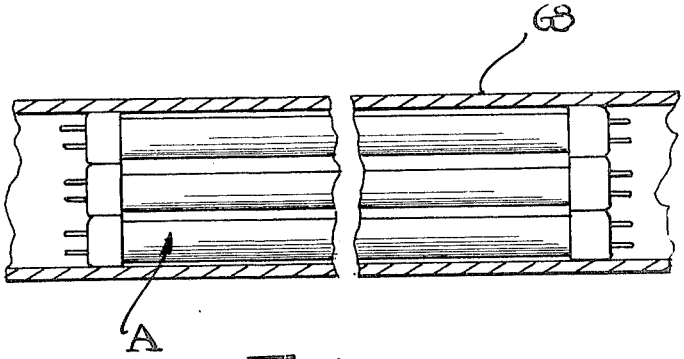
Figure 11:
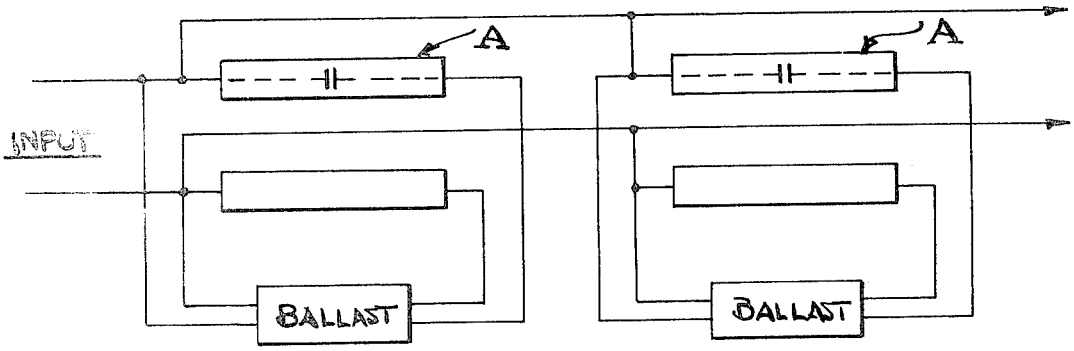
Figure 12:
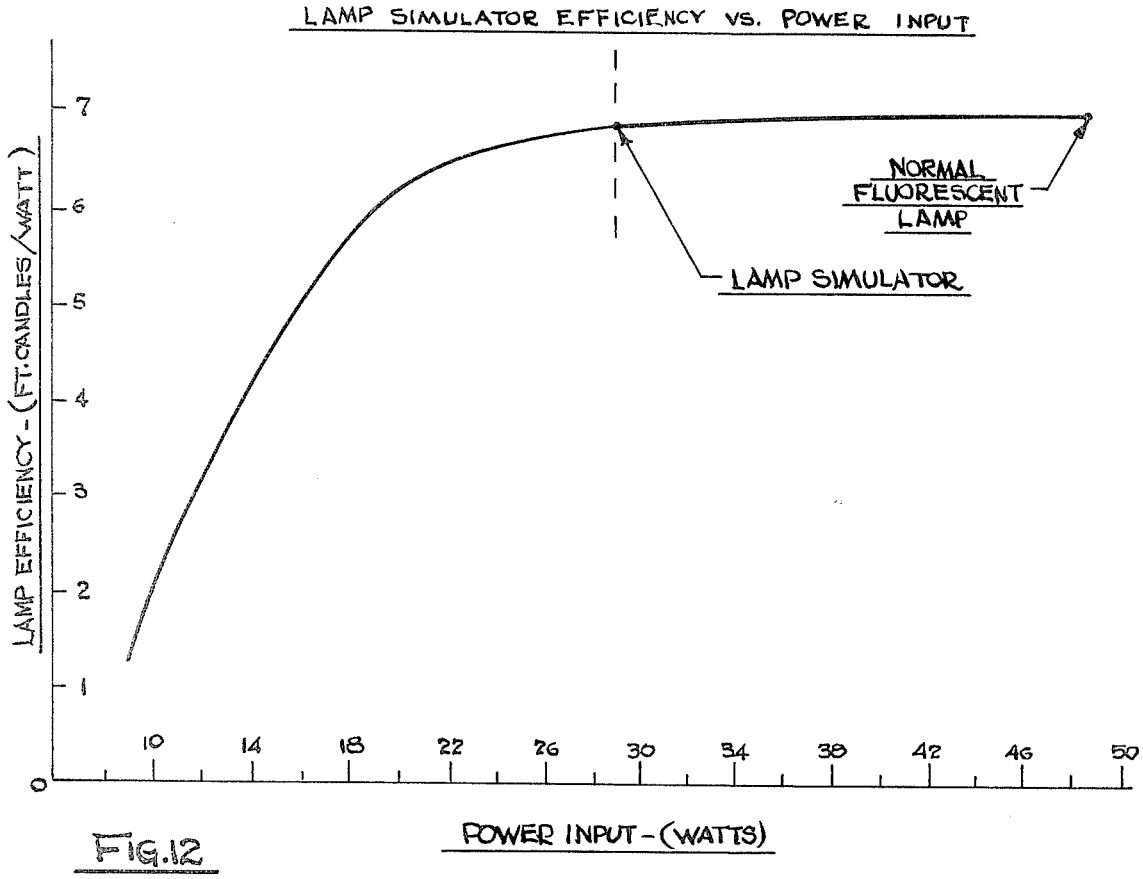
Figure 13:
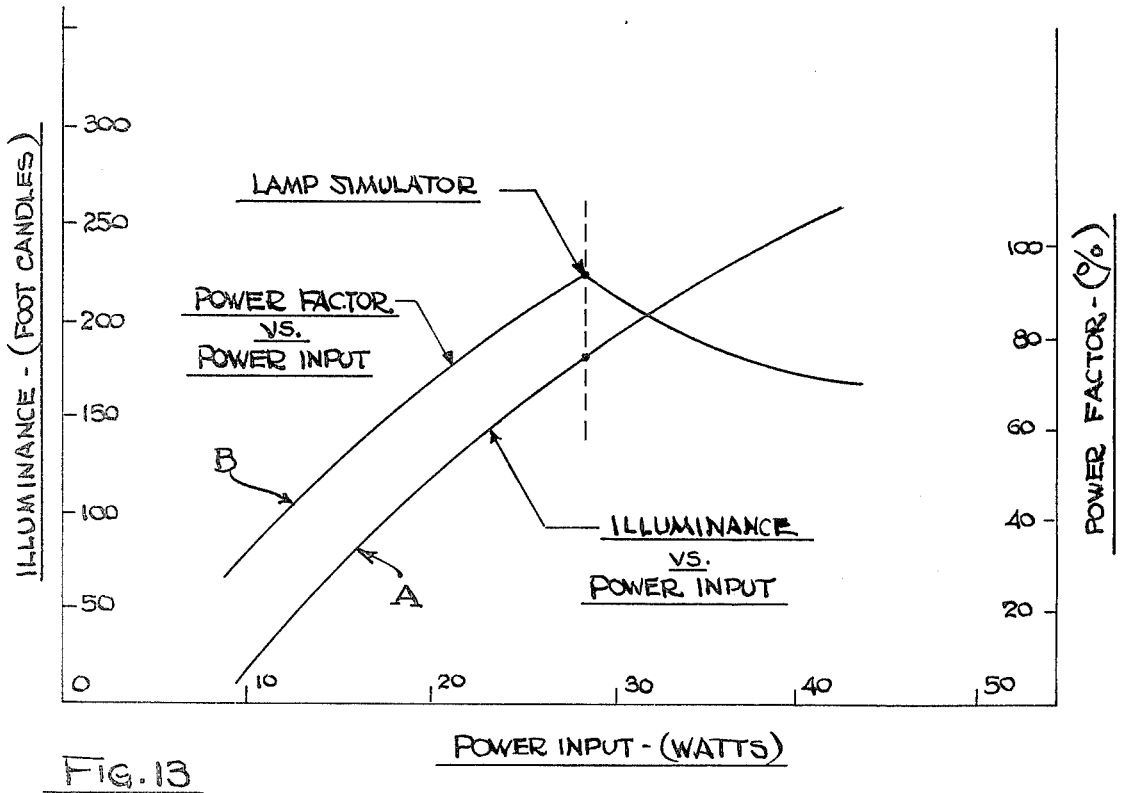

Having thus described the invention in general terms, reference will now be made to the accompanying drawings in which:

FIG. 1 is a schematic view showing a bank of light producing phosphor energizable lamps in a rectangular array thereof;

FIG. 2 is a schematic view, somewhat similar to FIG. 1, and showing in dotted lines, some of the light producing lamps removed therefrom and replaced by lamp simulators;

FIG. 3 is a schematic view, somewhat similar to FIGS. 1 and 2, and showing additional light producing lamps having been removed and replaced with lamp simulators of the invention, in accordance with a method in the invention;

FIG. 4 is a fragmentary partial sectional view showing the construction of a conventional prior art phosphor energizable lamp;

FIG. 5 is a side elevational view, partially broken away and in section, and showing one of the lamp simulators constructed in accordance with and embodying the present invention;

FIG. 6 is a vertical sectional view taken along line 6—6 of FIG. 5;

FIG. 7 is a side elevational view, showing a means for connecting a capacitor to one of the end caps of a lamp simulator of the invention;

FIG. 8 is a side elevational view, somewhat similar to FIG. 7 and showing a means for mounting a capacitor to another form of end cap used in a lamp simulator of the present invention;

FIG. 9 is a fragmentary vertical sectional view showing in more detail the actual mounting of a capacitor to an end cap in accordance with the present invention;

FIG. 10 is a somewhat schematic view in section and showing a plurality of lamp simulators packaged in a container in accordance with the present invention;

FIG. 11 is a schematic circuit view showing an electrical circuit employed with a lamp simulator of the invention substituted for a non-light producing lamp in a two-lamp fixture;

FIG. 12 is a graphical illustration showing the lamp efficiency verses the power input obtained with the lamp simulators of the present invention; and FIG. 13 is a graphical illustration showing the illuminance verses the power input for an existing lamp when used in conjunction with a lamp simulator of the invention.

DETAILED DESCRIPTION OF PREFERRED EMBODIMENTS

Referring now in more detail and by reference characters to the drawings which illustrate practical embodiments of the present invention, FIGS. 1–3 show a method for removing lamps in a rectangular array and replacing such removed lamps with lamp simulators. FIG. 1, for example, shows four rows of illuminatable lamps designated as 2, 4, 6, and 8 and with six existing phosphor energizable lamps in each of said rows.

In accordance with a first step of the method of the invention, alternate lamps in each of the rows are removed such that an existing lamp in one row will be adjacent to a space where a lamp has been removed in the next adjacent row. In other words, a space where a lamp has been removed will be surrounded by four existing lamps, or otherwise, an existing lamp will be surrounded by spaces where four lamps have been removed. In accordance with the method, lamp simulators are replaced for each of these removed lamps and further, lamp simulators of the present invention are employed as hereinafter described.

In accordance with another step in this method of the invention, all of the lamps in alternate rows, as for example, in rows 4 and 8 are removed. Thus, it can be observed that only rows 2 and 6 will have actual light emitting lamps and rows 4 and 8 will have only lamp simulators. Moreover, in rows 2 and 6 which do have energizable and light emitting lamps, they are each separated by alternate lamp simulators.

In accordance with this invention, it has been found that it is possible to reduce, well over half the number of existing lamps in an array without noticeably perceptably reducing the light load to the user of the environment. For example, in cases of bowling establishments where a very substantial number of lamps were previously employed, it has been found that the average user of the bowling alley does not even recognize the fact that lamps have been removed in a very substantial number. This is particularly true in the case of the present invention when the lamp simulators of this invention have been employed. This is due to the fact that the lamp simulators of the invention actually create an appearance as though they are generating light. Consequently, while the total light output has been reduced and does not otherwise affect the activity in the environment in which the remaining lamps are generating light, total energy savings have been dramatically increased.

The typical fluorescent lamp is only one embodiment of a phosphor excitable lamp. The fluorescent lamp is also a gaseous discharge lamps of a conventional construction, and one of such lamps L is more fully illustrated in FIG. 4 of the drawings. The typical fluorescent lamp comprises a bulb 10, which is shown as having a straight glass tube, although the tube often adopts other shapes, as for example, a circular shape, or the like. One end of the tube 10 is provided with a non-conductive base or cap 12 having a plurality (two as shown) of electrical terminals 14. These terminals, which are often referred to as "base pins", are connected to lead-in wires 16 located internally within the tube, and the lead-in wires are located in a so-called "stem press" 18 constructed of a material to assure the same coefficient of expansion as the glass tube 10. The lead-in wires 16 are connected to a hot cathode which is designed to ignite a gas in the tube as hereinafter described. The hot cathode is coated with an emissive material which emits electrons and is usually made of a coil, e.g., a simple coil tungsten wire. In many commercial embodiments, a pair of similar hot cathodes and related structure would be included at each end of the glass tube 10.

The inside of the bulb or tube 10 is provided with a phosphor coating which transforms ultraviolet radiation into the visible light. The color of the light often depends on the composition of the phosphor. A minute amount of mercury is also located in the bulb to furnish the mercury vapor for purposes of ignition. In addition, an inert gas, such as argon, krypton, and the like, may be used. The coating on the hot cathode is generally formed of an emissive material such as barium, strontium, calcium oxide, or the like, and which emits electrons when heated to an operating temperature of about 950 degrees C. After the cathode has been heated to the proper temperature, thermionic emission will occur. The emitted electrons, upon collision, will release ultraviolet radiation which is converted into visible light by the phosphors.

A lamp simulator may also be provided for an electroluminescent lamp in the present invention. The conventional electroluminescent lamp is comprised of a plastic plate which is translucent and preferably transparent in its construction. Applied to one surface of this plate is a phosphor coating and disposed against the phosphor coating is a metal sheet such as an aluminum sheet. Conductors are attached to the phosphor coating and the metal sheet. These conductors are adapted for connection to a suitable source of current through a ballast, and in the case of the present invention, would be connected to inputs of the generator. The electroluminescent lamp operates on essentially the same principle as the gaseous discharge lamp. However, in this case, the phosphors are not located in a tube or bulb. The electroluminescent lamp operates with a very high frequency creating a capacitive effect across the phosphor coating and the metal sheet with the phosphors converting the ultraviolet radiation into visible light radiation.

FIGS. 5 and 6 illustrate one embodiment of a lamp simulator A of the present invention. In this case, the lamp simulator A generally adopts the form of a fluorescent lamp. The lamp simulator A includes an outer housing 20 which is preferably tubular and elongate and having a hollow interior 22 and which is provided at each of its transverse ends with end caps 24 and 26. In this respect, the housing 20 has a size and shape similar, except for end portions thereof, to a conventional fluorescent lamp. However, the end caps 24 and 26 do not necessarily have an appearance in size and shape which is similar to that of the end caps on a normal fluorescent lamp as hereinafter described.

Each of the end caps 24 and 26 are provided with a pair of terminals 28 and 30 respectively and which are designed to fit within the slots of a conventional socket-type connector in a conventional fluorescent lamp fixture. In many cases, some fluorescent lamps are designed with only one terminal on each of the end caps and again, the present invention contemplates any form of terminal means which is conventional in the art.

Located within the interior chamber 22 of the housing 20 is a conventional capacitor 32 and which is connected to at least one of the terminals 28 and 30 on each of the end caps 24 and 26, respectively, by means of an electrical conductor 34. In view of the fact conductor 34 extends through the interior of the lamp simulator housing 20, it is not necessary to insulate the same. Moreover, no part of the conductor 34 is exposed to the exterior. Each end of the conductor is connected to one of the terminals 28 and 30 as aforesaid. Further, in the event of repair, the end caps 24 and 26 can be easily removed, e.g., unsnapped from the housing 20 and the exposed conductor 34 is available for re-soldering, or the like.

An adhesive member, such as a band of adhesive tape 36, is mounted on the exterior of the housing 20, in the manner as illustrated in FIG. 4. In this way, the adhesive tape 36 can be used to adhesively secure the lamp simulator A to the fixture in which it is used. In this respect, other forms of fastening means could be used in place of the adhesive tape 36. While the terminals 28 do fit within the slots in the socket-type connectors on the fixture, the advantage of the adhesive tape 36 is that it provides an additional fastening means for lamps with substantial length, e.g., lamps having a length of six feet. Otherwise, the tape 36 functions as a temporary fastening means when initially installing the lamp simulators. Due to the fact that the lamp housing is constructed of a plastic material, it has a greater tendency than a glass housing to sag or bend, and the use of the tape avoids this problem.

In one embodiment of the invention, the interior surface of the housing 20 is provided with a plurality of either upstanding or recessed elements regularly spaced apart in order to provide an irregular surface appearance. In one of the preferred aspects, a plurality of spaced apart longitudinally extending ridges 38 is provided on the surface in order to create a serrated effect on the interior surface of the housing 20, in the manner as illustrated in FIG. 6. Inasmuch, as the plurality of ribs are regularly spaced apart from each other, they appear as a plurality of splines and thus the serrated or ribbed effect can be referred to as a "splined effect". This is highly advantageous so that when one of the lamp simulators is substituted for an existing lamp in a two-lamp fixture, the remaining lamp when energized, will cause light to pass through the lamp simulator. Moreover, the light passing through the lamp simulator is highly dispersed by virtue of the surface effect, and in particular with this ribbed splined effect, thereby creating an appearance as though the simulator itself is generating light. In fact; unless the observer views the simulator from a very close distance, it is difficult to determine that the lamp simulator itself is not giving off light when located adjacent to an illuminated fluorescent lamp.

In another one of the preferred aspects of the invention, the housing itself is made of a platic material, and preferably a styrene. In this way, the housing is not only non-breakable, in the manner as glass, but also has many other advantages in that it can be easily extruded at a relative low cost. Thus, in the production of the lamp simulators, it is only necessary to provide an extruded tube with this ribbed or splined effect on the interior and apply the end caps thereto, much in a snap-fitting arrangement. Further, extrusion is facilitated since the lamp housings have a relatively constant cross sectional size and shape over their length.

The use of the grooves in the lamp simulator allows for a thin walled construction in the housing 20. In this way, it is possible to extrude the lamp housings at a fairly high rate and also on a very economical basis. Moreover, the thin walled construction along with the grooves provides the necessary degree of rigidity and strength. Further, the thin walled construction, along with the grooves, actually aides in light dispersion.

In the prior art constructions which used glass and even if they had been made from resins, such as acrylic resins, the light would have typically reflected off of a bulb. This problem has been obviated in the case of the present invention.

In another one of the embodiments of the present invention, the capacitor 32 may be physically mounted on one of the end caps as for example, an end cap 40. In the embodiment of the invention as illustrated in FIG. 7, the end cap 40 is provided with a single terminal 42 having an aperture extending therethrough. Moreover, the capacitor 32 is physically mounted against the interior surface of the end cap 40, much in the manner as illustrated. One end of an electrical conductor 34 is electrically connected to the capacitor 32 and also to the terminal 42. The other end of the capacitor 34 would be conventionally connected to one terminal on the other end cap as for example the end cap 26. This construction allows easy interchangability of the capacitor when needed. Moreover, in the actual manufacture of the device it is convenient to mount the capacitor 32 on the end cap 40 in view of the fact that it is not thereby necessary to provide any other structure located within the interior of the lamp housing to support the capacitor. Moreover, it is not necessary to insulate the wire electrical conductor 34 by use of this construction since it is always enclosed in the lamp housing.

FIG. 8 illustrates a slightly modified form of the invention in which an end cap 44 having a pair of terminals 46 is provided. In this case, one of the terminals is provided with an aperture extending therethrough and a capacitor 32 is mounted in relationship to this terminal. Again, the electrical conductor 34 has one end connected to the capacitor 32 and the other to the terminal 46 having the aperture therein.

It should be understood that this technique in accordance with the present invention could be used with any form of terminal arrangement on the end caps, as for example, the so-called "single pin", "medium-bipin" or "recessed double contact".

The lamp simulators of the present invention are highly effective for use with the so-called rapid start type ballasts. These ballasts are typically designed to start and operate two lamps in series. Depending upon a particular configuration, four or more lamps could be included in a particular fixture operated by one ballast. Moreover, the lamp simulators of the present invention, while reducing the light level, also proportionally reduce the amount of electrical power required. Moreover, by using the simulators of the invention, when the energized lamps are removed in proper amounts, the lumen output still meets certain Federal Energy Administration requirements.

FIG. 9 illustrates an embodiment of the invention utilizing a commerically available end cap from a conventional fluorescent lamp tube. In this embodiment of the invention, the light simulator comprises an elongate tubular plastic housing 50, substantially similar to the housing 20 and which is circular in shape and having a constant diametral cross section over its length. Disposed over each of the transverse ends, one as shown, is an end cap 52 which is preferably formed of a metal material, such as aluminum, or the like. Each of the end caps 52 is provided with a relatively flat outer wall 54 having an integrally formed annularly extending end flange 56 which engages the exterior surface at the periphery of the transverse end of the housing 50. Moreover, the end flanges 56 may be secured to the end portions of the tube 50 by means of an adhesive or the like.

The relatively flat end walls 54 of the end caps 52 are provided with recessed sections 57 and fitted within the recessed sections 57 of each end cap is an insert 58, preferably formed of a dielectric material. Moreover, a pair of contacts 60 are formed on the inner surface of the dielectric material 58 of each end cap. In addition, a pair of terminals 62 on each end cap extend outwardly through the insert 58 and are connected to the contacts 60. Only one of the contacts 60 as shown since it is possible to provide only one end cap or further the end cap could be actually incorporated with a capacitor as hereinafter described. In this embodiment of the invention, a capacitor 64 is physically connected to one of the contact 62, as by means of soldering or the like, in the manner as illustrated in FIG. 9. The other terminal of the capacitor 64 is connected to an electrical conductor 66.

The embodiment of the simulator illustrated in FIG. 9 is one of the more preferred since the lamp housing can be constructed at a low cost due to the fact that it has a relatively constant cross sectioned shape over its length. Moreover, by virtue of the fact that the end caps are slightly diametrally larger, a plurality of lamp simulators can be packaged in a single container, designated as 68, and as shown in FIG. 10, without the necessity of individual paperboard liners or other liners or sleeves. Thus, only the end caps are abutted against each other as shown and the lamp housings are spaced apart from each other to prevent abutment and resultant abrasion. Further, by use of this construction breakage is reduced and and shipping costs are substantially reduced.

FIG. 11 illustrates an arrangement in which one fluorescent lamp has been removed from each of two fixtures and a lamp simulator of the present invention substituted for the fluorescent lamp in each of said fixtures. The amount of wattage required in this arrangement to power the lamps was reduced from 192.4 watts where four fluorescent bulbs were required to about 55 watts, resulting in a savings of about 137.2 watts. The power factor in each case is about 93%. It can be observed that no rewiring was required and no special knowledge or electrical circuit ability is required to make the change. Moreover, in the arrangement where four fluorescent lamps were employed, the amount of amperes used was 1.6 for a measured period of time and for the same period of time with two lamp simulators in place of two of the normal fluorescent lamps, only 0.46 amperes were required at 120 volts.

FIG. 12 illustrates a lamp efficiency obtained in a conventional two lamp fixture when one of the lamp simulators of the present invention is substituted for one of the two light emitting lamps in such two lamp fixture. It can be observed that the use of the lamp simulators of the present invention along with an existing lamp in a two lamp fixture obtained substantially equal efficiency to a fixture in which two energizable and illuminatable lamps were employed, while accomplishing a 71% reduction in total power input required. The light output in footcandles is reduced in luminance by only 46% compared to the luminance of one lamp isolated and operating in an unaltered circuit configuration.

The lamp simulators of the invention are designed to achieve a maximum power factor with the capacitive substitution, as illustrated. FIG. 13 shows the power factor on the right-hand side versus the input power in watts on the lower portion of the graph. The lamp simulators of the invention obtain a peak power factor of 92% as illustrated in the curve designated as B. The curve designated as A is the luminance in footcandles as related to the power input. A light level of about 185 footcandles on the curve A relates to the vertical dash line extending downwardly from the drop-off point on the power factor versus power input curve A. It can be understood that a projected design at greater power input would provide more luminance although efficiency would suffer considerably. Thus, the lamp simulators of the invention are designed to achieve a maximum power factor.

Thus, there has been illustrated and described a unique and novel lamp simulator as a replacement for a phosphor energizable lamp in a plural lamp fixture which presents a normal lamp effect and which is relatively inexpensive to manufacture and repair. Thus, the present invention fulfills all of the objects and advantages sought therefore. It should be understood that many changes, modifications, variations, and other uses and applications will become apparent to those skilled in the art after considering this specification and the accompanying drawings. Therefore, any and all such changes, modifications, and other uses which do not depart from the spirit and scope of the invention are deemed to be covered by the invention which is limited only by the following claims.

Having thus described my invention, what I desire to claim and secure by letters patent is:

1. A substitute lamp simulator as a replacement for a phosphor energizable lamp in a plural lamp fixture, said lamp simulator comprising:

(a) a lamp housing, (b) end caps on each of the opposite ends of said housing, (c) terminal means on each of said end caps capable of being fitted into connectors which receive the terminals of a phosphor energizable lamp, (d) a capacitor physically mounted on one of said end caps and being electrically connected to the terminal means on said end cap, and (e) electrical conductor means electrically connecting said capacitor to the terminal means on the other of said end caps.

2. The substitute lamp simulator of claim 1 further characterized in that said lamp simulator constitutes a replacement for a fluorescent bulb and said housing is a tubular housing.

3. The substitute lamp simulator of claim 2 further characterized in that said electrical conductor means is a wire extending within said housing.

4. The substitute lamp simulator of claim 3 further characterized in that said wire is uninsulated.

5. The substitute lamp simulator of claim 2 further characterized in that said tubular housing is formed of a relatively non-breakable plastic material.

6. The substitute lamp simulator of claim 5 further characterized in that a plurality of splines are formed on the inside of said housing and extend for at least the major part of the axial length of said housing.

7. For use with a lighting fixture with socket-type connectors adapted to have at least two phosphor energizable discharge lamps connected thereto, a non-illuminatable lamp simulator replacable for one of the lamps in said fixture and permitting the other of the lamps to produce substantially normal lumen output with substantially normal power input to the operating lamp or lamps, said lamp simulator comprising:

(a) a lamp housing, (b) end caps on each of the opposite ends of said housing, (c) terminal means on each of said end caps capable of being fitted into connectors which receive the terminals of a phosphor energizable lamp, (d) a capacitor physically mounted on one of said end caps and being electrically connected to the terminal means on said end cap, and (e) electrical conductor means electrically connecting said capacitor to the terminal means on the other of said end caps.

8. The lamp simulator of claim 7 further characterized in that said lamp simulator constitutes a replacement for a fluorescent bulb and said housing is a tubular housing.

9. The lamp simulator of claim 8 further characterized in that said electrical conductor means is a wire extending within said housing.

10. The lamp simulator of claim 9 further characterized in that said wire is uninsulated.

11. The lamp simulator of claim 8 further characterized in that said tubular housing is formed of a relatively non-breakable plastic material.

12. For use with a lighting fixture with socket-type connectors adapted to have at least two fluorescent lamps connected thereto, a non-illuminatable lamp simulator replacable for one of the lamps in said fixture, (a) a tubular elongate lamp housing, (b) end caps on each of the opposite ends of said housing, (c) terminal means on each of said end caps capable of being fitted into said socket-type connectors which receive the terminals of a fluorescent lamp, (d) a plurality of closely spaced apart elements on the interior of said lamp housing and being located for at least the greater portion of the length of said housing to form an irregular interior surface effect, said irregular surface effect on the inner surface of said lamp housing creating substantial light dispersion and substantial elimination of shadows such that an energizable lamp in proximity to the lamp simulator causes light to disperse through the lamp housing of the simulator and thereby create an appearance that the lamp simulator is generating light, (e) electrically conductive means in said housing and being electrically connected to said terminal means on said end caps for permitting the remaining one or more lamps in said fixture to produce substantially normal lumen output with substantially normal power input to the operating lamp or lamps.

13. The lamp simulator of claim 12 further characterized in that said electrically conductive means is a non-reactive high resistivity wire.

14. The lamp simulator of claim 13 further characterized in that said electrically conductive means is a wire with a capacitor connected thereto.

15. The lamp simulator of claim 12 further characterized in that:

(a) a capacitor is physically mounted on one of said end caps and is electrically connected to the terminal means on said end cap, and (b) said electrically conductive means electrically connecting said capacitor to the terminal means on the other of said end caps.

16. The lamp simulator of claim 12 further characterized in that said tubular housing is formed of a relatively non-breakable plastic material.

17. The lamp simulator of claim 12 further characterized in that an adhesive section is located on an exterior surface portion of said lamp simulator for attachment to said fixture.

18. The lamp simulator of claim 12 further characterized in that said spaced apart elements are generally spaced apart elongate ridges extending for the greater portion of the length of said housing.

19. A substitute lamp simulator as a replacement for a phosphor energizable lamp in a plural lamp fixture, said lamp simulator comprising:

(a) lamp housing formed of a plastic material, said housing having an elongate tubular wall with a pair of opposed transverse opened ends and having a relatively constant cross-sectional area across its length, (b) an end cap secured to and enclosing the open ends of said lamp housing, each said end cap comprising:

(1) an end wall extending across the open transverse end of the lamp housing, (2) a continuous annularly extending flange projecting from said end wall and snuggly engaging the end portion of the tubular wall at said transverse end such that the flange has a greater diameter than the tubular wall at that portion of the tubular wall such that the flange extends outwardly of any portion of said tubular wall, and (c) electrically operative means within said housing and being connected between the end caps at each transverse end so that said simulator may replace an existing lamp in a plural lamp fixture and allowing the remaining lamp or lamps to produce substantially normal lumen output with substantially normal power input to the operative lamp or lamps, or with a reduced lumen output and proportionally reduced power input to the operating lamp or lamps and with substantially the same efficiency of operation of the remaining operating lamp or lamps, said electrically operative means comprising a capacitor physically mounted on the end wall of one of said end caps.

20. The lamp simulator of claim 19 further characterized in that said electrically operative means comprises an electrical conductor extending between a conductive terminal on one of said end caps and the capacitor on the other of said end caps.

21. The lamp simulator of claim 19 further characterized in that said lamp housing is provided with a plurality of closely spaced apart elements on the interior of said lamp housing and being located for at least the greater portion of the length of said housing to form an irregular interior surface effect, said irregular surface effect on the inner surface of said lamp housing creating substantial light dispersion and substantial elimination of shadows such that an energized lamp in proximity to the lamp simulator causes light to disperse through the lamp housing of the simulator and thereby create an appearance that the lamp simulator is generating light.

22. The lamp simulator of claim 21 further characterized in that said spaced apart elements are generally spaced apart elongate ridges extending for the greater portion of the length of said housing.

23. The lamp simulator of claim 19 further characterized in that said annularly extending flange has a relatively flat outer wall so that a plurality of the lamp simulators are capable of being packaged in a container such that the end caps on each of the opposed transverse ends are in contact with end caps on immediately adjacent lamps and the lamp housing is spaced from the lamp housings on such immediately adjacent lamps.

24. A substitute lamp simulator as a replacement for a phosphor energizable lamp in a plural lamp fixture, said lamp simulator comprising:

(a) lamp housing formed of a plastic material said housing, said lamp housing comprising:

(1) an elongate tubular wall with a pair of opposed transverse opened ends and having a relatively constant cross-sectional area across its length, (2) a plurality of closely spaced apart elements on the interior of said lamp housing and being located for at least the greater portion of the length of said housing to form an irregular interior surface effect, (b) an end cap secured to and enclosing the open ends of said lamp housing, each said end cap comprising:

(1) an end wall extending across the open transverse end of the lamp housing, (2) a continuous annularly extending flange projecting from said end wall and snuggly engaging the end portion of the tubular wall at said transverse end such that the flange has a greater diameter than the tubular wall at the portion of the tubular wall such that the flange extends outwardly of any portion of said tubular wall, and (c) electrically operative means within said housing and being connected between the end caps at each transverse end so that said simulator may replace an existing lamp in a plural lamp fixture and allowing the remaining lamp or lamps to produce substantially normal lumen output with substantially normal power input to the operating lamp or lamps, or with a reduced lumen output and proportionally reduced power input to the operating lamp or lamps and with substantially the same efficiency of operation of the remaining operating lamp or lamps, said irregular surface effect on the inner surface of said lamp housing creating substantial light dispersion and substantial elimination of shadows such that an energized lamp in proximity to the lamp simulator causes the light to disperse through the lamp housing of the simulator and thereby create an appearance that the lamp simulator is generating light.

25. The lamp simulator of claim 24 further characterized in that said electrically operative means comprises a capacitor connected to said electrical conductor.

26. The lamp simulator of claim 25 further characterized in that said capacitor is physically mounted on the end wall of one of said end caps.

27. The lamp simulator of claim 24 further characterized in that said spaced apart elements are generally spaced apart elongate ridges extending for the greater portion of the length of said housing.

* * * * *